US011852333B1

(12) United States Patent
Harvey et al.

(10) Patent No.: US 11,852,333 B1
(45) Date of Patent: Dec. 26, 2023

(54) LIGHT FIXTURE WITH GLARE REDUCTION PANELS

(71) Applicant: ABL IP Holding LLC, Atlanta, GA (US)

(72) Inventors: John Bryan Harvey, Newark, OH (US); Vincent Adams, Snellville, GA (US); Phillip Ryan Wagner, Baltimore, OH (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/972,718

(22) Filed: Oct. 25, 2022

(51) Int. Cl.

| | |
|---|---|
| ***F21V 5/02*** | (2006.01) |
| ***F21V 15/01*** | (2006.01) |
| ***F21Y 115/10*** | (2016.01) |
| *F21W 131/101* | (2006.01) |
| *F21W 131/103* | (2006.01) |

(52) U.S. Cl.
CPC ..... *F21V 5/02* (2013.01); *F21V 15/01* (2013.01); *F21W 2131/101* (2013.01); *F21W 2131/103* (2013.01); *F21Y 2115/10* (2016.08)

(58) Field of Classification Search
CPC . F21V 5/005; F21V 5/02; F21V 5/008; F21V 15/01; F21S 8/085; F21S 8/086; F21S 8/088; F21S 8/043; F21S 8/046; F21S 8/04; F21S 8/033; F21W 2131/101; F21W 2131/103
See application file for complete search history.

(56) References Cited

U.S. PATENT DOCUMENTS

| | | | | |
|---|---|---|---|---|
| 10,379,278 B2 | 8/2019 | Wilcox et al. | | |
| 2023/0194068 A1 * | 6/2023 | Lim | ..... | F21V 5/008 362/217.02 |

FOREIGN PATENT DOCUMENTS

| | | | | |
|---|---|---|---|---|
| DE | 102006047689 A1 * | 10/2007 | ..... | F21S 2/00 |
| DE | 102010046082 A1 * | 3/2012 | ..... | F21S 8/085 |
| DE | 202019105265 U1 * | 2/2021 | ..... | F21S 4/28 |
| EP | 1679470 A2 * | 7/2006 | ..... | F21S 8/04 |
| GB | 2360353 A * | 9/2001 | ..... | F21S 8/04 |
| WO | WO-2018065364 A1 * | 4/2018 | ..... | F21S 8/04 |
| WO | WO-2022180298 A1 * | 9/2022 | | |

* cited by examiner

*Primary Examiner* — Erin Kryukova
(74) *Attorney, Agent, or Firm* — Kilpatrick Townsend & Stockton LLP

(57) ABSTRACT

A light fixture having a front and opposing lateral sides, the light fixture includes at least one light source configured to emit a plurality of light rays towards the front and opposing lateral sides, each light ray is emitted at a first angle relative to an optical axis of the at least one light source, and at least one panel extending adjacent to the at least one light source and configured to refract the light rays emitted towards the opposing lateral sides such that light rays exit the at least one panel at a second angle relative to the optical axis that is less than the first angle.

24 Claims, 14 Drawing Sheets

LIGHT FIXTURE WITH GLARE REDUCTION PANELS

FIELD OF INVENTION

The present technology relates to light fixtures, and more particularly to light fixtures that include at least one panel to redirect high angle light emitted from light sources within the light fixture.

BACKGROUND OF INVENTION

Light fixtures are often positioned on the outer walls of buildings or on the walls within tunnels and underpasses to illuminate desired areas, such as parking lots, roadways or pathways. In the tunnel or underpass situation, these light fixtures cast light downwardly and outwardly to illuminate the road for vehicles traveling under the underpass or within the tunnel. However, the light fixtures tend to emit high angle light rays that create glare and reduce visibility for drivers approaching the underpass or tunnel.

BRIEF SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined by the below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

An embodiment of the present invention relates to a light fixture having a front and opposing lateral sides, the light fixture includes at least one light source configured to emit a plurality of light rays towards the front and opposing lateral sides, each light ray is emitted at a first angle relative to an optical axis of the at least one light source, and at least one panel extending adjacent to the at least one light source is configured to refract the light rays emitted towards the opposing lateral sides such that light rays exit the at least one panel at a second angle relative to the optical axis that is less than the first angle.

BRIEF DESCRIPTION OF THE DRAWINGS

The disclosure will be readily understood by following detailed description in conjunction with the accompanying drawings, in which.

DETAILED DESCRIPTION

Figure 1:
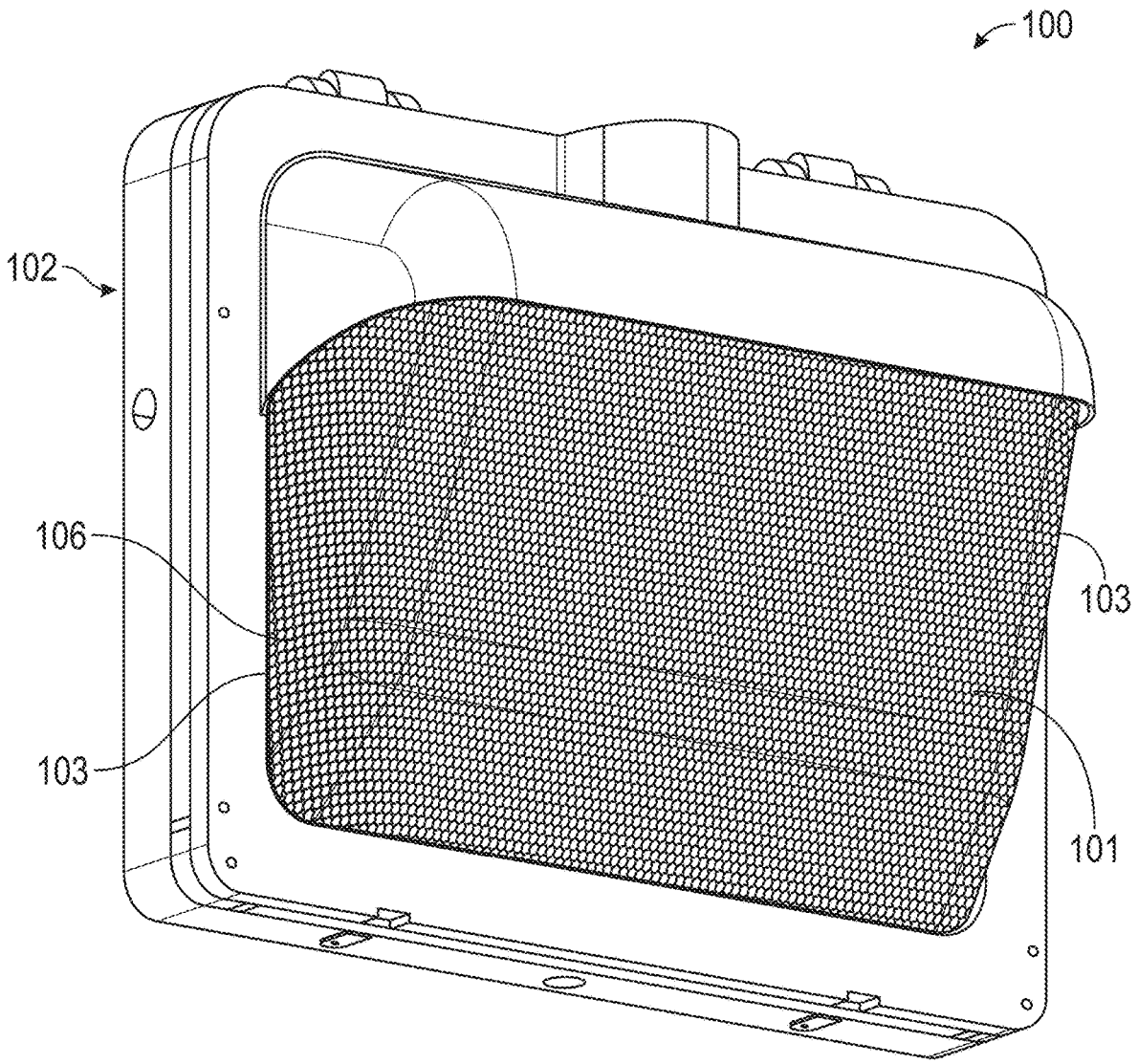
FIG. 1 is a perspective view of an embodiment of a light fixture in accordance with the present disclosure.

The subject matter of embodiments of the present invention is described here with specificity to meet statutory requirements, but this description is not intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Each example is provided by way of illustration and/or explanation, and not as a limitation. For instance, features illustrated or described as part of one embodiment may be used on another embodiment to yield a further embodiment. Upon reading and comprehending the present disclosure, one of ordinary skill in the art will readily conceive many equivalents, extensions, and alternatives to the specific, disclosed luminaire types, all of which are within the scope of embodiments herein.

In the following description, positional terms like "above," "below," "vertical,""horizontal," "bottom," "top," and the like are sometimes used to aid in explaining and specifying features illustrated in the drawings as presented, that is, in the orientation in which labels of the drawings read normally. These meanings are adhered to, notwithstanding that the luminaires herein may be mounted to surfaces that are not horizontal. When light is said to be emitted "downwardly" at least most of such light is emitted across one or more angles that are below horizontal when a luminaire is oriented as shown in the drawings; such angles include nadir but are not limited to nadir. Similarly, when light is said to be emitted "upwardly" at least most of such light is emitted across one or more angles that are above horizontal when a luminaire is oriented as shown in the drawings; such angles include zenith but are not limited to zenith.

Embodiments are directed to light fixtures provided with one or more glare reduction panels that reduce the amount of high angle light emitted from the light fixture. While the figures and the description below illustrate and describe embodiments of the light fixture contemplated herein, the shape and configuration of the components of the light fixtures shown in the figures is merely exemplary and are not limiting. Rather, the light fixture may be shaped differently, be formed from different components, and/or configured to emit light in other directions than what is described herein. It some embodiments, it is envisioned that the light fixtures be positioned adjacent a roadway (such, as a tunnel, underpass, etc.) or a walkway but such is not a requirement. Rather, the light fixtures may be positioned at or coupled to any surface where surrounding light is desired. Furthermore, embodiments of the glare reduction panels disclosed herein may be incorporated into any type of light fixture, particularly (but not necessarily) ones where reduction of high angle light is beneficial.

FIG. 1 shows a perspective view of an embodiment of a light fixture 100 that generally includes a housing 102, a light engine 104 (not visible in FIG. 1), and a lens 106 through which light emitted from the light engine 104 exits the light fixture 100 from the front 101 and opposing sides 103 of the lens 106. The housing 102 in this illustrated embodiment is configured to house the components of the light fixture 100. The light engine 104 is positioned internally of the housing 102 and is configured to emit light downwardly and outwardly from the light fixture 100. The lens 106 may serve both as an aesthetic cover and to functionally direct or diffuse light emitted from the light engine 104.

Figure 2:
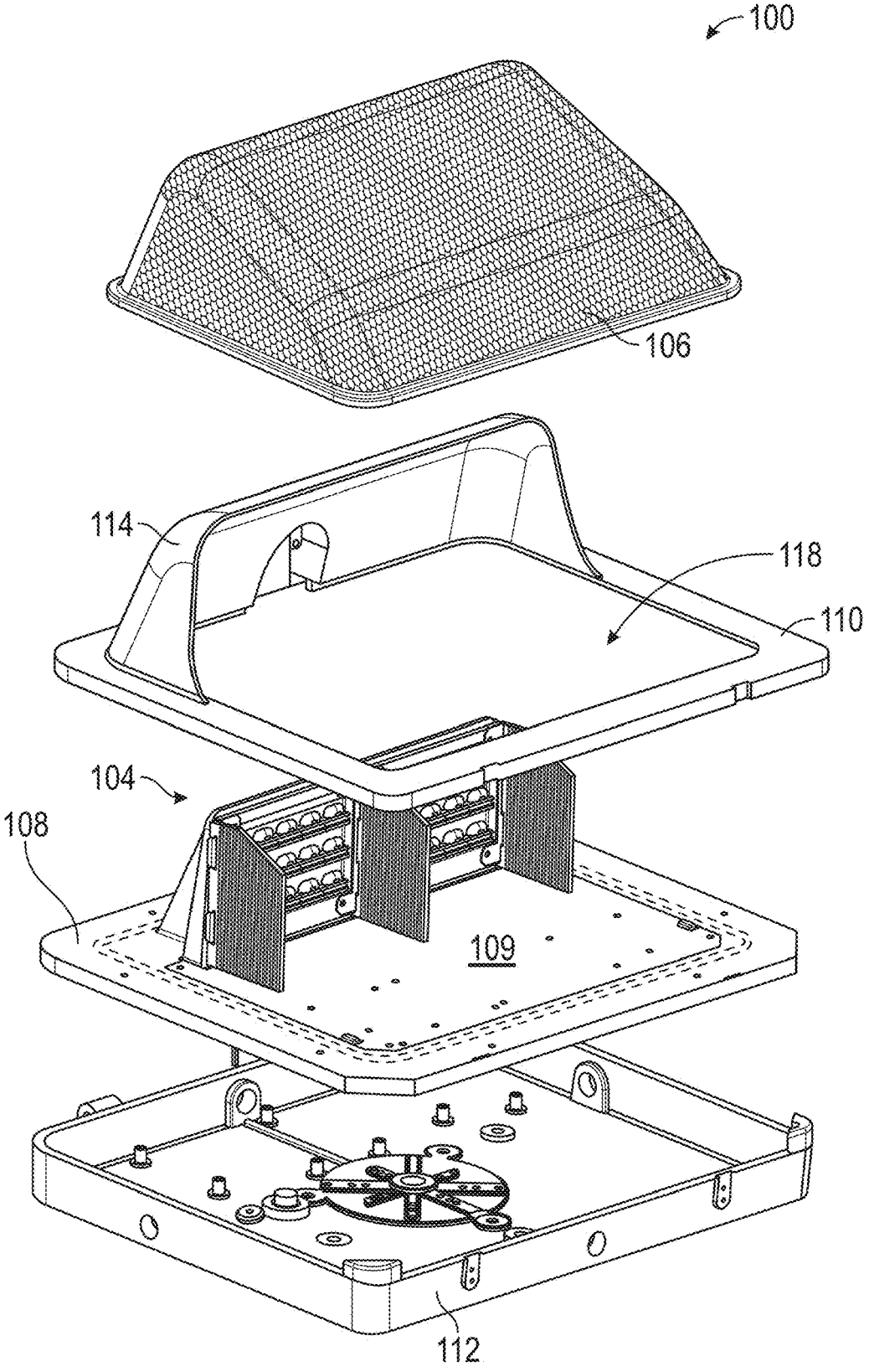
FIG. 2 is an exploded view of the light fixture housing of FIG. 1.

With reference to FIG. 2, the housing 102 includes a base 108 that is sandwiched between a front plate 110 and a back plate 112. The base 108, front plate 110, and back plate 112 may be formed of any material(s) having the requisite structural rigidity and tolerance for indoor and/or outdoor lighting conditions, such as, but not limited to, suitable metallic and polymeric materials. In some embodiments, these components are formed from a thermally conductive material to help dissipate the heat generated by the light sources. For example, in some embodiments these components are formed from metal (such as aluminum or steel) to promote heat dissipation from the light sources.

Figure 3:
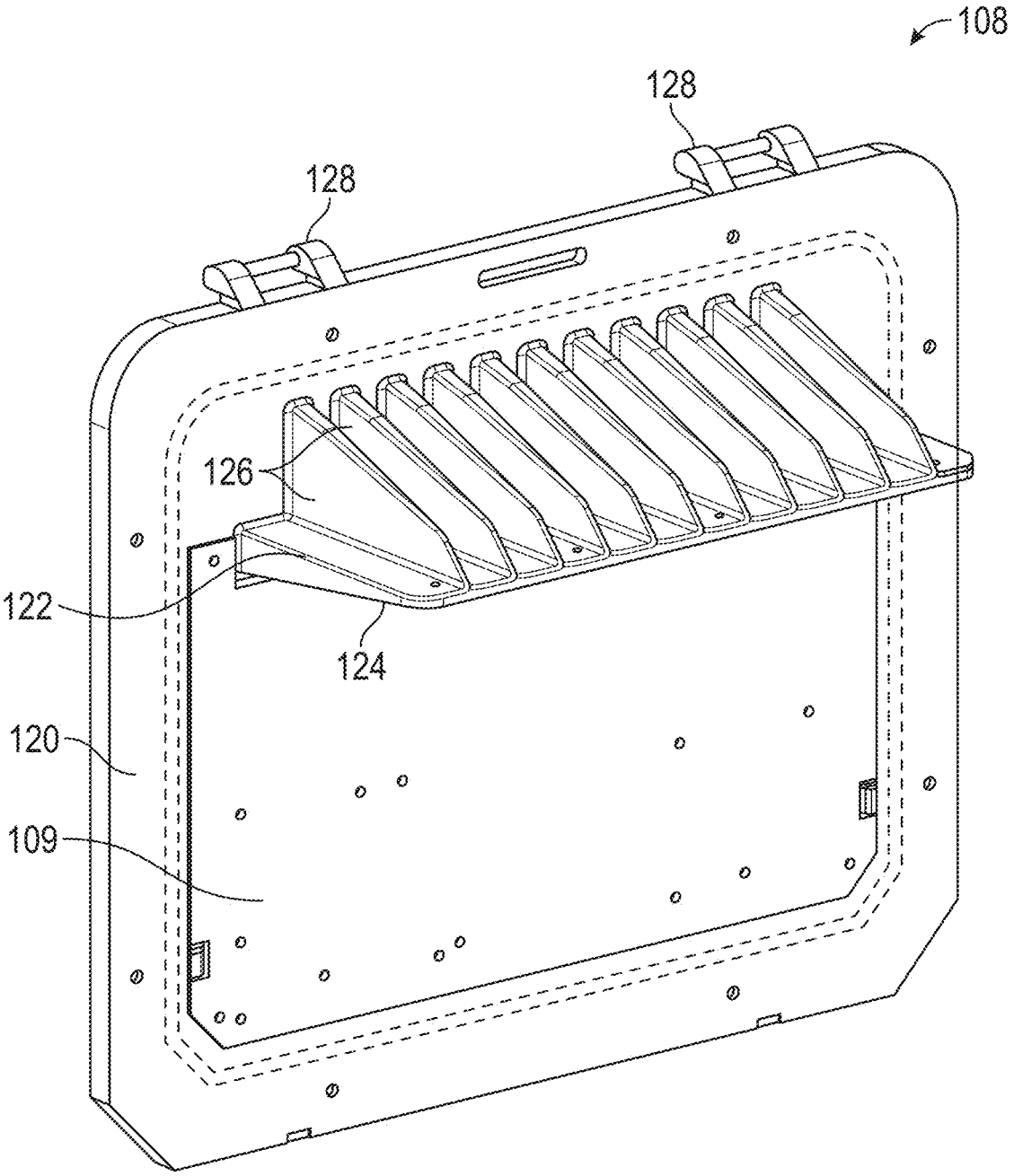
FIG. 3 is a perspective view of a base of the light fixture of FIG. 1.

The base 108 is shown in isolation in FIG. 3 and includes a base body 120, a reflector (or reflective surface) 109, and a mounting platform 122. The base body 120 is shown as a generally rectangular-shaped frame in which a separate reflector 109 plate is positioned. Note, however, that in other embodiments the base body 120 and the reflector 109 may be formed integrally such that the reflector 109 is essentially a reflective surface provided on the base body 120.

A mounting platform 122 extends outwardly from the front plane of the base body 120 and includes a mounting surface 124 and optional heat dissipation fins 126. The mounting surface 124 may extend at any angle relative to the front plane of the base body 120. In some embodiments, the mounting surface 124 extends substantially perpendicularly relative to front plane of the base body 120 and provides a surface to which the light engine 104 may be mounted. The reflector 109 is provided to ensure emitted light is reflected outwardly from the light fixture 100.

Fins 126 are shown as being generally triangularly shaped, with a first edge extending along the base body 120 and an adjacent second edge extending along a surface of the mounting platform 122 opposite the mounting surface 124. The one or more fins 126 may provide structural support to the mounting surface 124 and the light engine 104 while also providing additional surface area as to more efficiently dissipate heat produced by the light engine 104. Still referring to FIG. 3, a plurality of fins 126 are shown, however, this is merely exemplary and any number of fins 126 (or no fins) may be provided. In the illustrated embodiment, one or more hinge pins 128 extend from the edge of the base body 120 for coupling the base 108 and the back plate 112, allowing for any components positioned within the back plate 112 to be easily accessed.

Figure 4:
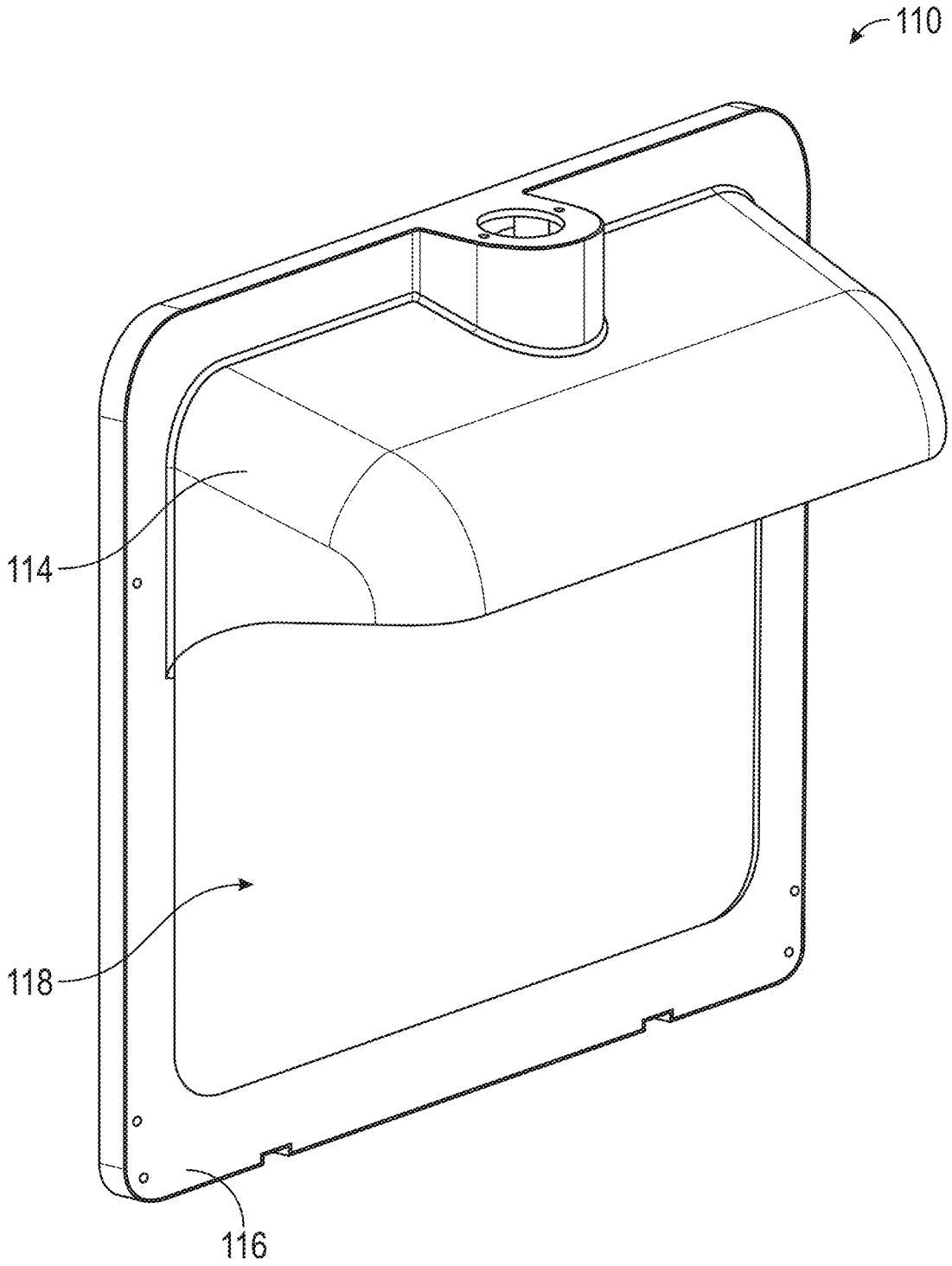
FIG. 4 is a perspective view of a front plate of the light fixture of FIG. 1.

The front plate 110 is positioned in front of the base 108 and, as best seen in FIG. 4, includes a front plate body 116 that can, but does not have to, define an opening 118. An upper ledge 114 extends outwardly from the front plate body 116 and is configured to extend over the mounting platform 122. The front plate 110 may be coupled to the back plate 112 and/or the base 108 using fasteners, snap-fit, form-fit, or other methods known in the art, as discussed further below.

Figure 5:
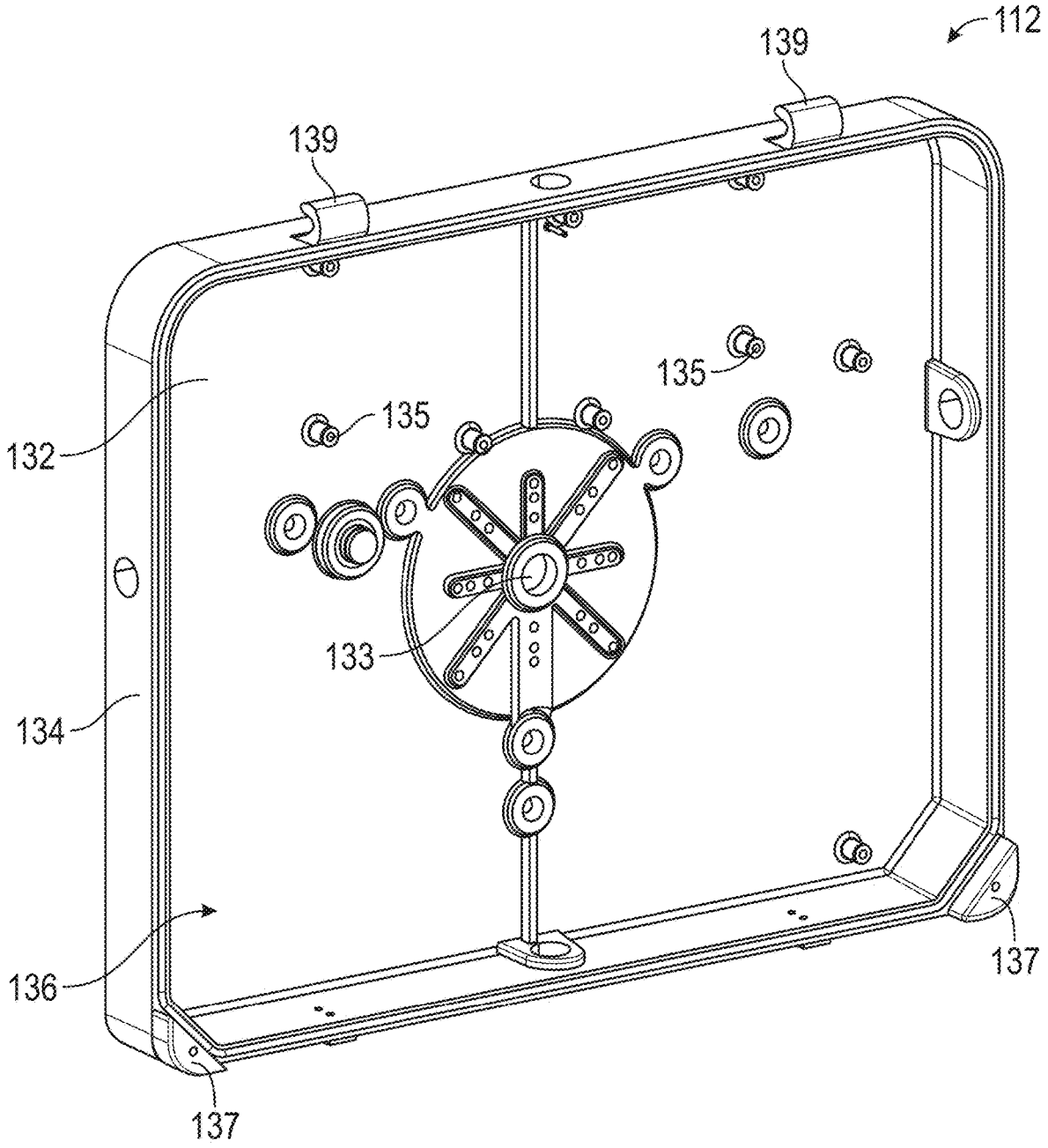
FIG. 5 is a perspective view of a back plate of the light fixture of FIG. 1.

The back plate 112 is positioned behind the base 108 and supports the electronic components of the light fixture 100 while also providing a coupling point for the light fixture 100 to be affixed to an external surface such as those discussed above. FIG. 5 depicts the back plate 112 in isolation. The back plate 112, as shown, has a generally rectangular body that includes a back wall 132 and an outer frame 134 that extends outwardly from and at least partially around the perimeter of the back wall 132. The back wall 132 provides a surface for both securing the light fixture 100 to an exterior surface as well as providing protection for electronic and mechanical components that are positioned within the housing 102. A power aperture 133 is provided for receiving power into the light fixture 100. A plurality of mounting apertures 135 are provided on the back wall 132 and may be configured to accept fasteners to couple the light fixture 100 to an exterior surface.

In the illustrated embodiment, mounting tabs 137 may extend from the outer frame 134 to a height that is greater than the thickness of base 108. In this way, the mounting tabs 137 with associated coupling means, such as an aperture, may be used to secure the front plate 110 to the back plate 112 using fasteners, adhesives, or other methods known in the art, thus sandwiching the base 108 between the front plate 110 and the back plate 112. When the back plate 112 is coupled to the base 108, a cavity 136 is defined therebetween. The cavity 136 may be used to house electronics that control and/or power the light fixture 100. One or more hinge knuckles 139 extend from the back plate 110 and are configured to engage the hinge pins 128 of base 108 to form one or more hinge joints between the back plate 110 and base 108 to facilitate access to the contents of the cavity 136.

Figure 6A:
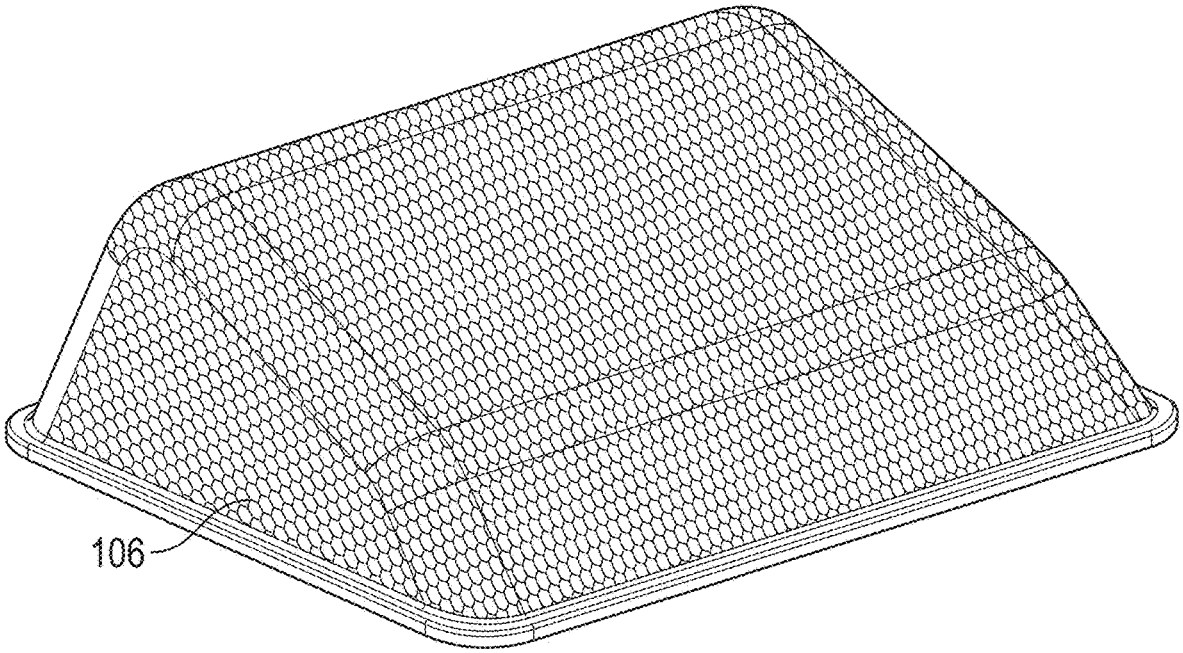
FIG. 6A is a perspective view of a lens of the light fixture of FIG. 1.
Figure 6B:
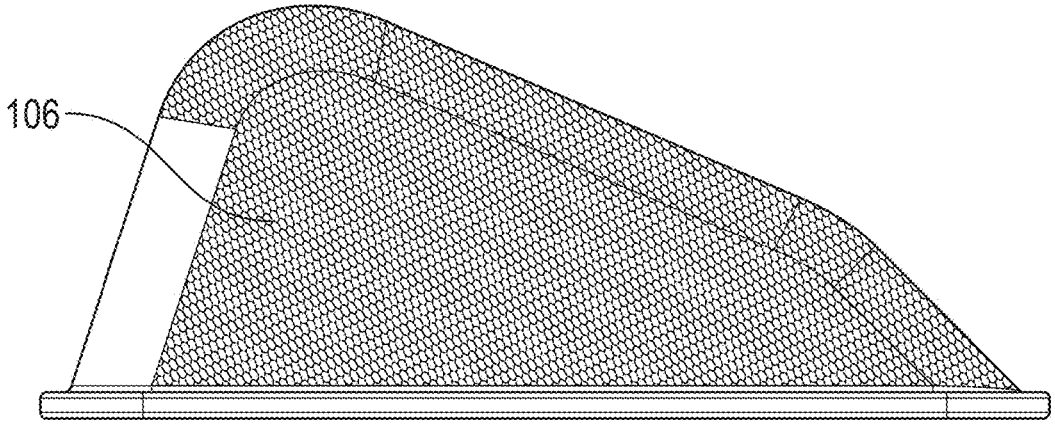
FIG. 6B is a side elevation view of the lens of FIG. 6A.

The lens 106 serves both as an aesthetic cover and to functionally direct or diffuse light emitted by the light engine 104. The lens 106 may be formed of glass or plastic (e.g., acrylic, polycarbonate, silicone, etc.), typically but not necessarily by molding. In some embodiments (see FIGS. 6A and 6B), the lens 106 includes optical enhancements to achieve a desired light distribution and effect from the light fixture 100. The lens 106 may be of any type (diffuse, prismatic, etc.) that achieves the desired light emission from the light fixture 100. However, the lens 106 may have any geometry and may be provided with any surface enhancements or no surface enhancements.

In the illustrated embodiment, the lens 106 generally has a side profile whereby the front 101 of the lens 106 tapers inwardly from the top to the bottom of the light fixture 100, but such is not a requirement. The lens 106 covers opening 118 of the front plate 110. In one, non-limiting embodiment, the lens 106 includes at least one flange that extends outwardly around at least a portion of the perimeter of the lens 106 and that is sandwiched between the base 108 and the front plate 110 to retain the lens 106 on the light fixture 100. The lens 106 as depicted in the figures is merely exemplary; a wide variety of shapes and configurations of lenses are envisioned to be within the scope of this disclosure.

Figure 7:
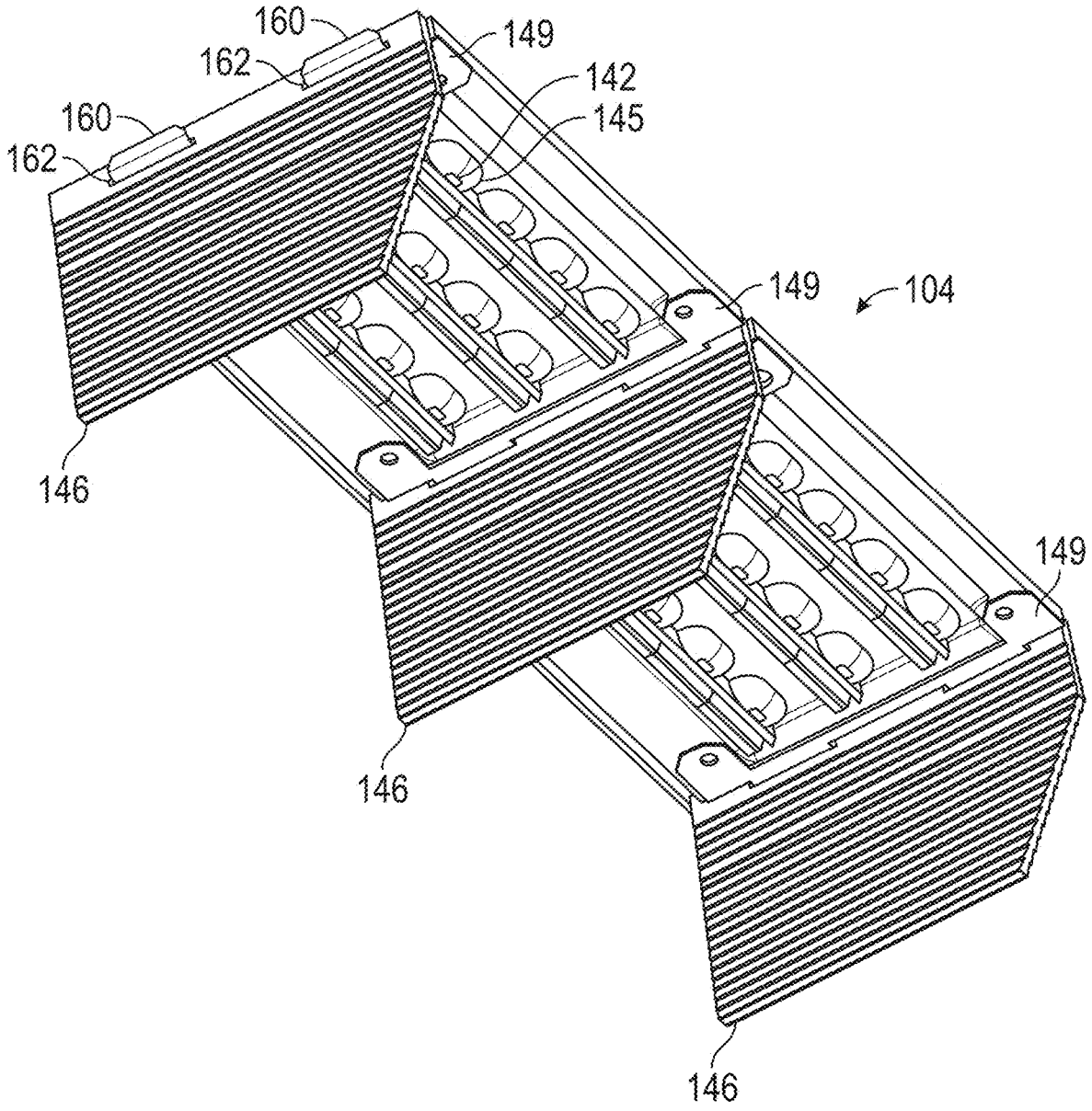
FIG. 7 is a perspective view of a light engine with glare reduction panels.
Figure 8:
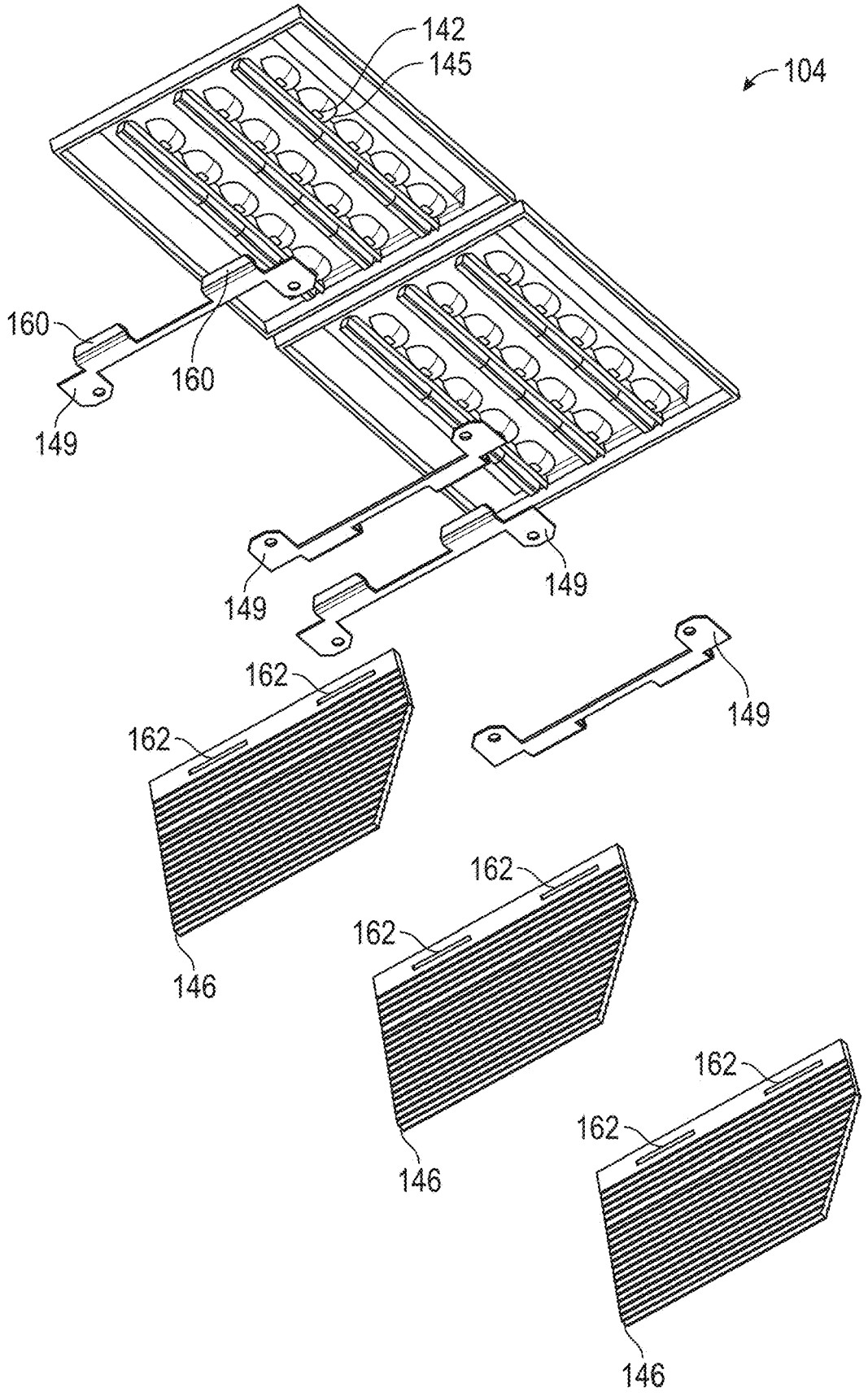
FIG. 8 is an exploded view of the light engine with glare reduction panels of FIG. 7.
Figure 9:
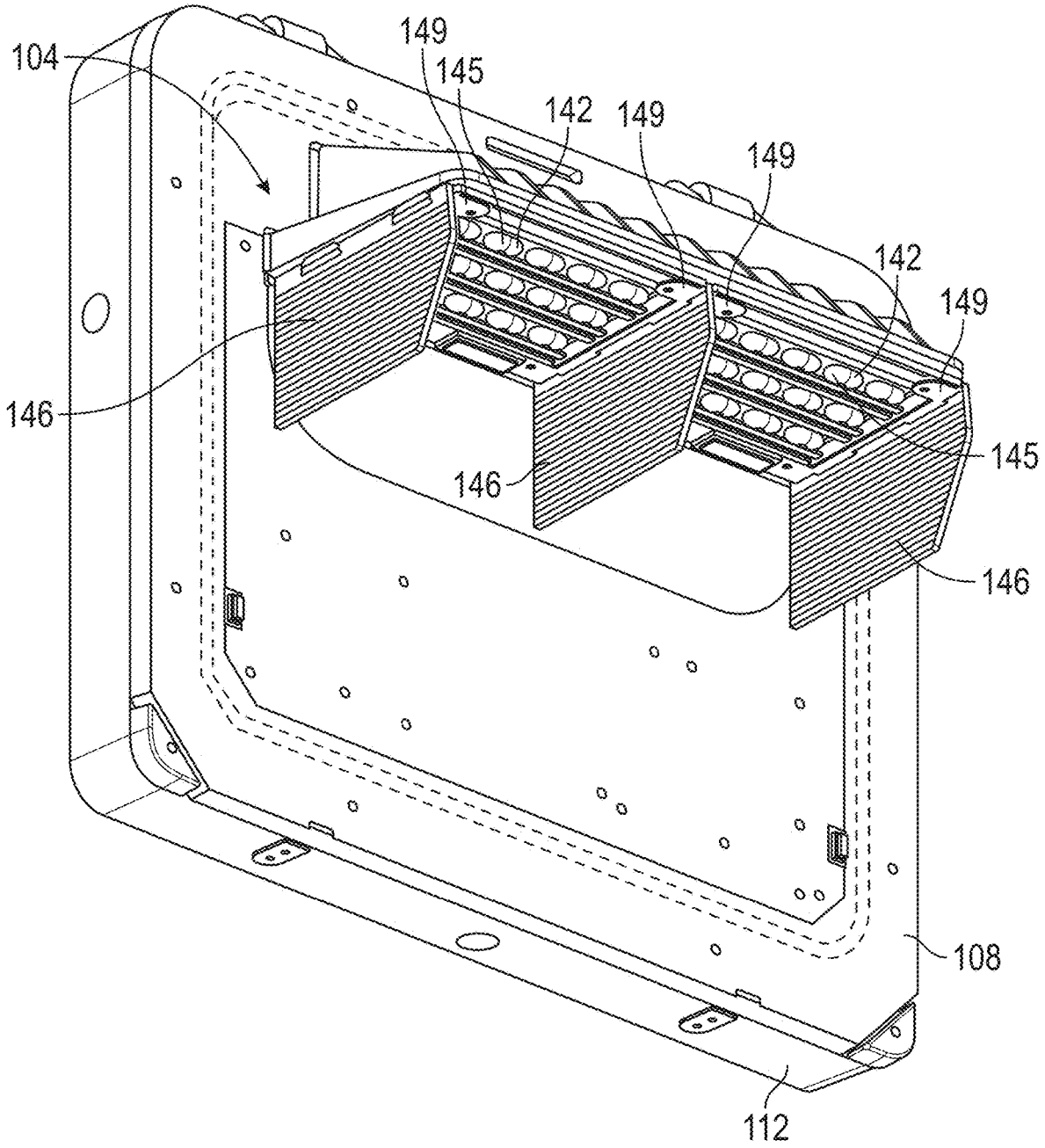
FIG. 9 is a perspective view of a light engine attached to the base of the light fixture of FIG. 1.

As seen in FIGS. 7 and 8, the light engine 104 includes at least one light source 142. The at least one light source 142 may be a light emitting diode ("LED"), a fluorescent lamp, a halogen lamp, an incandescent bulb, or any other light source 142 known in the art. In some embodiments, the light sources 142 are LEDs. Any number of LEDs or arrays of LEDs may be provided. The LEDs may be single-die or multi-die LEDs, DC or AC, or can be organic light emitting diodes. White, color, or multicolor LEDs may be used. Moreover, the LEDs need not all be the same color; rather, mixtures of LEDs may be used. A primary optic 145 may be provided over the light sources 142. A primary optic 145 may service multiple light sources 142 or each light source 142 may have its own dedicated primary optic 145. In some embodiments, the light sources 142 are mounted on a printed circuit board ("PCB") but in other embodiments no PCB is needed; rather, the light sources 142 are chip-on-board LEDs.

Figure 10:
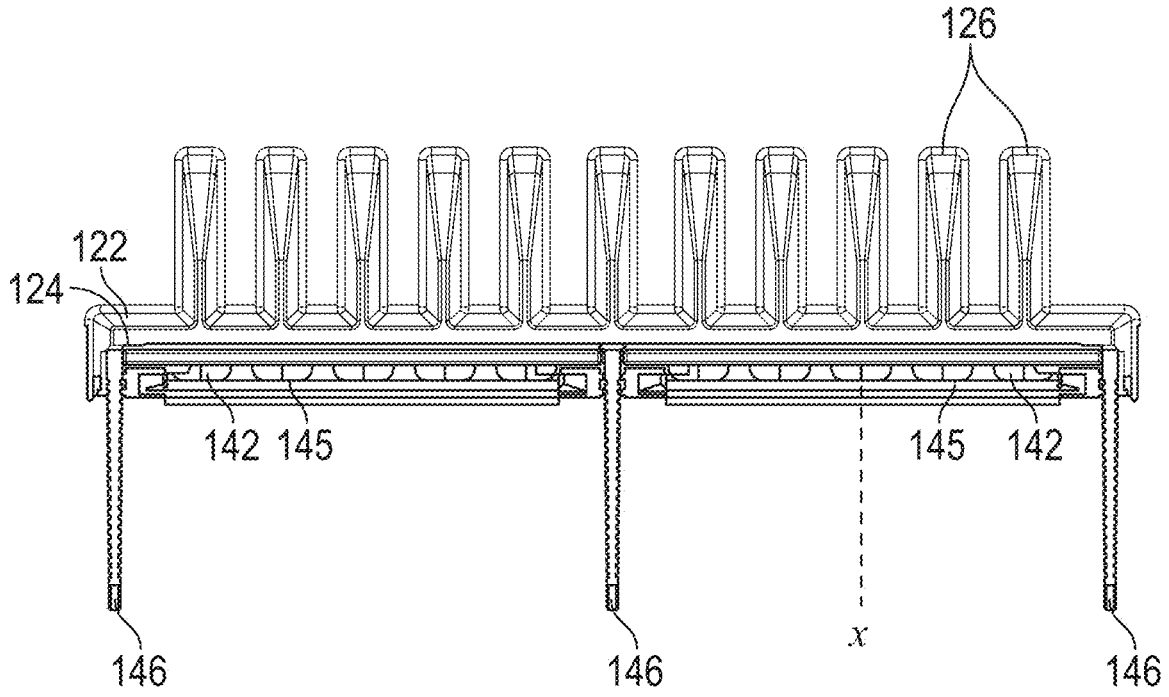
FIG. 10 is a front view of a light engine mounted on the mounting platform of FIG. 3.
Figure 11:
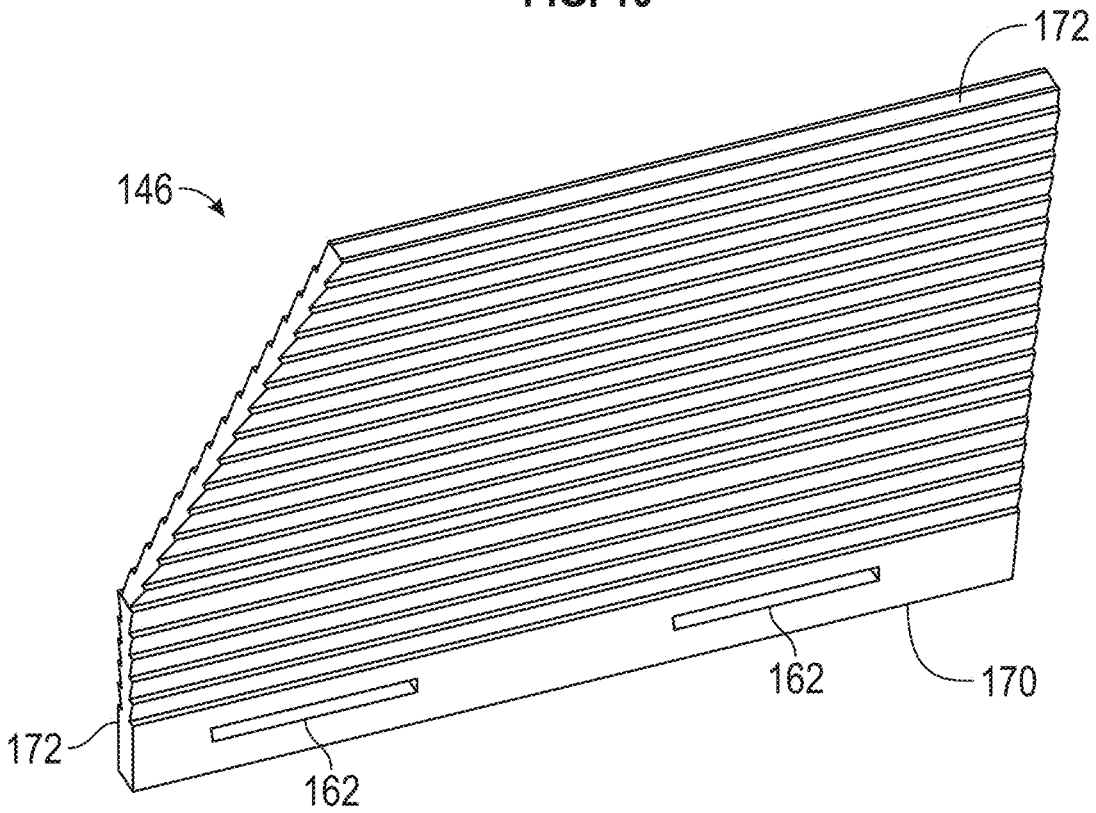
FIG. 11 is a perspective view of an embodiment of a glare reduction panel in isolation.
Figure 12:
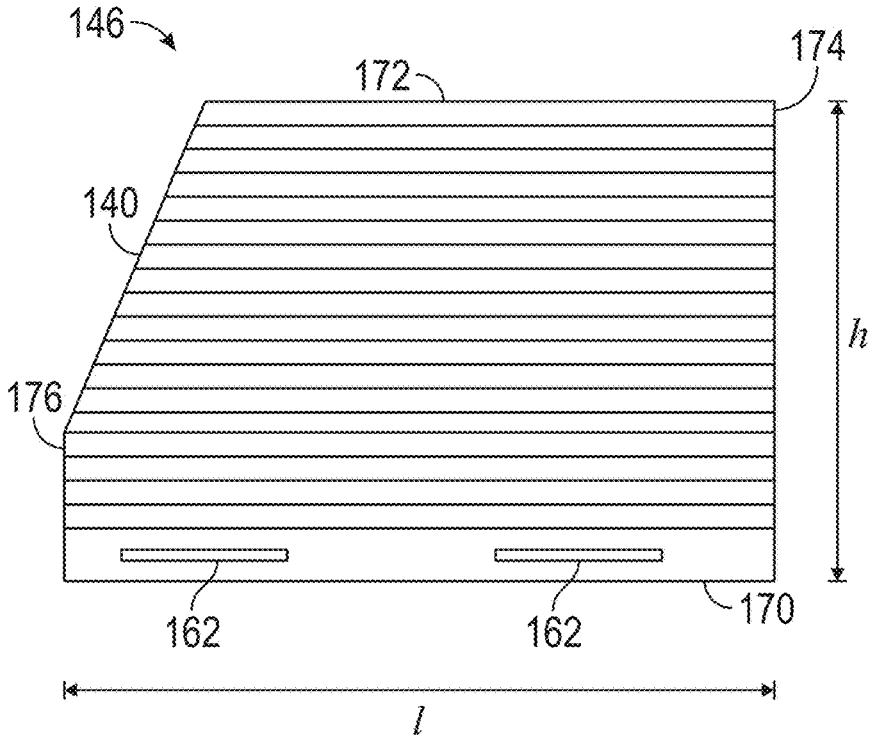
FIG. 12 is a side elevation view of the glare reduction panel of FIG. 11.
Figure 13:
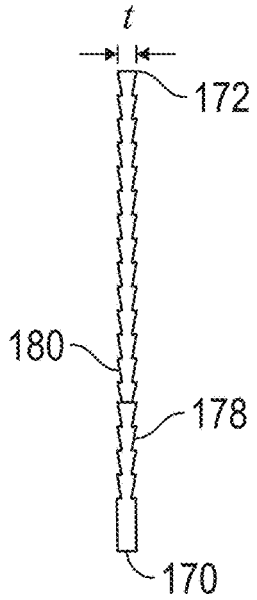
FIG. 13 is an end view of the glare reduction panel of FIG. 11.
Figure 14:
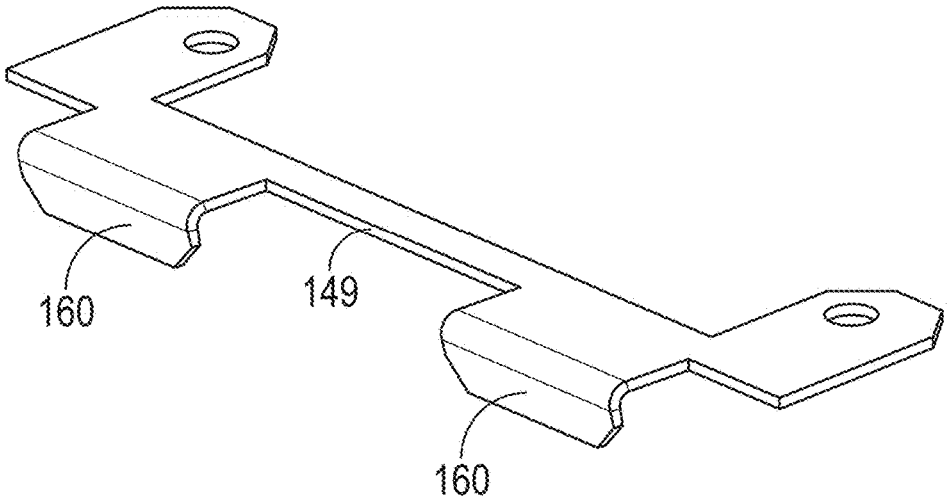
FIG. 14 is a perspective view of an embodiment of a mounting bracket in isolation.
Figure 15:
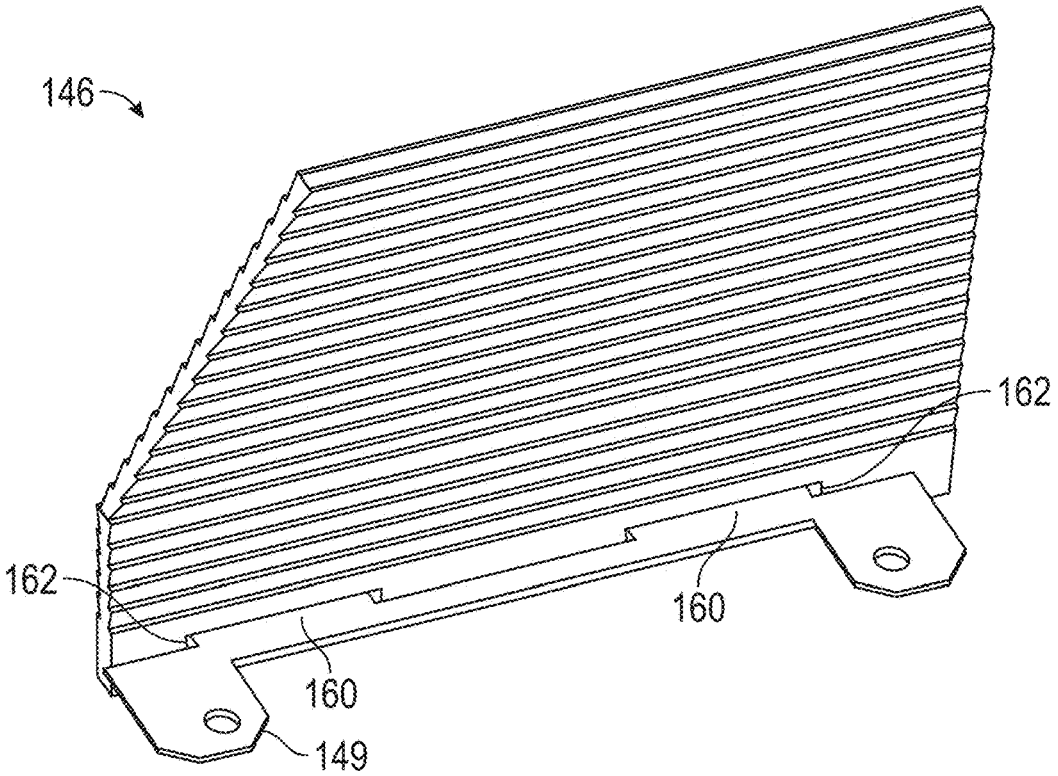
FIG. 15 is a perspective view of the glare reduction panel of FIG. 11 mounted on the mounting bracket of FIG. 14.

In some embodiments, the light engine 104 is mounted on the mounting surface 124 of the mounting platform 122. Any type of mechanical and/or chemical attachment methods can be used, such as, but not limited to, brackets, screws, or adhesives. Regardless, the light engine 104 is positioned within the light fixture 100 such that light emitted by the light sources 142 is directed in a generally outward and downward direction. In some embodiments where the light sources 142 are LEDs, the optical axis x (see FIG. 10) of at least some of the LEDs will extend substantially perpendicular to the mounting surface 124.

In some situations, the high angle light emitted by the light fixture 100 can be undesirable. For example, a light fixture 100 positioned under an underpass will emit light downwardly and outwardly from the fixture. Light emitted from the front of the light fixture 100 (such as via the front 101 of the lens 106) will generally be perpendicular to the direction of travel along the roadway and thus will not generally cause glare to a driver entering the underpass. Rather, the driver is most affected by high angle light that is emitted from the sides of the light fixture 100, such as via the opposing sides 103 of the lens 106. This high angle light can cause glare that obstructs a driver's visibility as s/he enters the underpass or tunnel.

To address and better control this high angle light, at least one glare reduction panel 146 is provided within the light fixture 100. In the illustrated embodiment, three glare reduction panels 146 extend downwardly from the mounting surface 124 proximate the light sources 142. However, any number of glare reduction panels 146 may be used. While in some embodiments, the glare reduction panels 146 extend substantially perpendicular to the mounting surface 124 and/or optical axes x of the light sources 142, the angular orientation of the glare reduction panels 146 can vary depending on the desired light output.

The glare reduction panels 146 redirect incoming light, reducing the angle at which the light exits the panel 146 and thus the light fixture 100. In some embodiments, the glare reduction panels 146 refract light emitted by the light sources 142. More specifically, the glare reduction panels 146 are designed to refract the light such that the angle of the light rays as they enter a panel 146 (the "entrance angle") is greater than the angle of the light rays as they exit the panel 146 (the "exit angle"). All angles referenced herein, unless otherwise mentioned, are measured from an axis extending perpendicularly downwardly from the mounting surface 124 and/or optical axes x, which in many situations will be nadir. The glare reduction panels 146 may be made of a transparent material, a semi-transparent (i.e., translucent) material, or semi-opaque material, including, but not limited to, glass, silicone, acrylic, polycarbonate, and the like.

The glare reduction panels 146 may be retained in the light fixture in any suitable manner (e.g., snap-fit, form fit, mechanical fasteners, or chemical fasteners). As shown in FIGS. 7-15, mounting brackets 149 may be provided with one or more tabs or hooks 160 that engage one or more mounting apertures 162 within a glare reduction panel 146. One or more mounting brackets 149 are attached to the mounting surface 124 to secure a glare reduction panel 146 to the mounting surface 124 and in fixed relation to the light sources 142.

The glare reduction panels 146 have a proximal end 170 (more proximate the light sources 142 when in situ), a distal end 172 (more distal the light sources when in situ), a height h measured from the proximal end 170 to the distal end 172, a first side edge 174, a second side edge 176, a length/ measured from the first side edge 174 to the second side edge 176, a first lateral side 178, an opposing second lateral side 180, and a thickness t measured between the first lateral side 178 and the second lateral side 180.

The height h of each glare reduction panel 146 may be selected to ensure that as much emitted high angle light as desired is directed into the glare reduction panel 146. In some embodiments, the height h of a glare reduction panel 146 is determined by calculating the maximum desirable angle of light—i.e., the maximum angle of light desired in a particular application to exit directly from the side of the light fixture 100 without interaction with a glare reduction panel 146—emitted by the light source 142 positioned furthest from a glare reduction panel 146, and setting the panel height h of that glare reduction panel 146 to ensure that any light that is emitted above the maximum allowable angle is directed into and refracted by the panel 146. In some embodiments, the maximum desirable angle of light is between 55° to 80°, inclusive; between 60° to 75°, inclusive; between 65° to 75°, inclusive; between 65° to 70°, inclusive. In some embodiments, light emitted at or below 80 °, 75°, 70°, 65°, and/or 60° exits the light fixture 100 without passing through a glare reduction panel 146. In some embodiments, the height h of the panels 146 is between .5 inches and 7.5 inches, inclusive; between 1 inch and 7 inches, inclusive; between 1 inch and 6 inches, inclusive; between 2 inches and 5 inches, inclusive; and/or between 2 inches and 4 inches, inclusive. In some embodiments, the height h of the panels 146 is approximately 1 inch, 2 inches, 3, inches, 4 inches, 5 inches, 6 inches, and/or 7 inches.

In some embodiments, the glare reduction panels 146 have a length/such that the first side edge 174 is located abutting or adjacent the base 108 and the opposing second side edge 176 is located abutting or adjacent the lens 106. In this way, all of the high angle light emitted toward the sides 103 of the lens 106 will pass through and be refracted downwardly by the glare reduction panels 146. The first and/or second side edges 174, 176 may be shaped or contoured to match the shape of the component adjacent to which they are positioned. For example, the second side edge 176 of the glare reduction panels 146 may include a cut-out or taper 140 to allow the panels 146 to be positioned flush with the lens 106 to ensure that the panel 146 captures as much as possible of the undesirable high angle light. In some embodiments, the length/of the panels 146 is between 2 inches and 15 inches., inclusive; between 3 inches and 14 inches, inclusive; between 3 inches and 10 inches, inclusive; between 5 and 14 inches, inclusive; and/or between 5 inches and 10 inches, inclusive. In some embodiments, the length/of the panels 146 is approximately 2 inches, 3 inches, 4 inches, 5 inches, 6 inches, 7 inches, 8 inches, 9 inches, 10 inches, 11 inches, 12 inches, 13 inches, and/or 14 inches.

The thickness t of each glare reduction panel 146 may remain constant or vary along the height h of the panels 146. In some embodiments, the panel 146 may gradually taper from a wider proximal end 170 to a narrower distal end 172. In some embodiments, the thickness t of the panel 146 is between .01 inches and .5 inches, inclusive; between .05 inches and .4 inches, inclusive; between .1 inches and .4 inches, inclusive; between .05 inches and .25 inches, inclusive; and/or between .2 inches and .3 inches, inclusive. In some embodiments, the thickness t of the panel 146 is approximately .01 inches, .05 inches, .1 inches, .15 inches, .2 inches, .25 inches, .3 inches, .35 inches, .4 inches, .45 inches, and/or .5 inches.

In some embodiments, the ratio of the thickness of the proximal end 170 to the distal end is 172 is 2:1; however, this number is merely exemplary and other thickness ratios are within the scope of this disclosure. One of skill in the art will recognize that the height h, length l, thickness t, and degree of taper of the panels 146 can be controlled and adjusted to achieve the desired light output.

Figure 16:
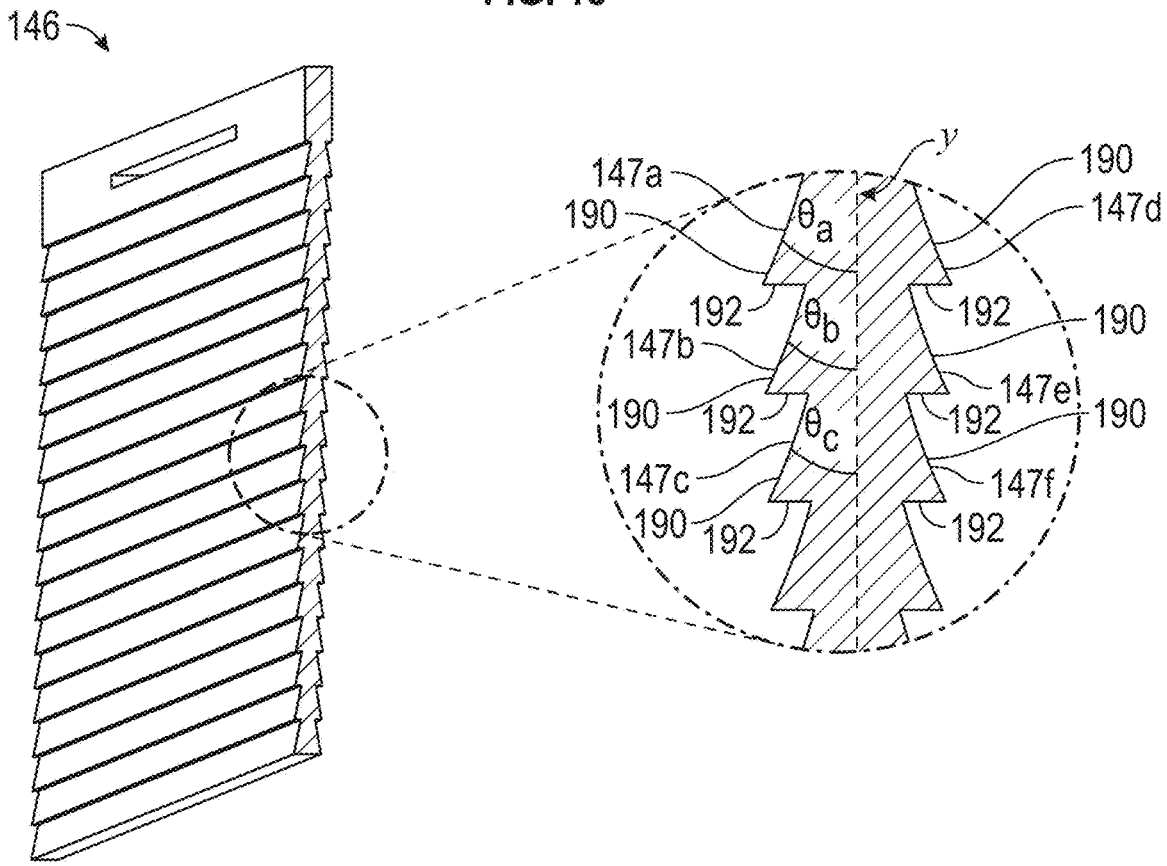
FIG. 16 is a partial cross-sectional end view of an embodiment of a glare reduction panel.

While in some of the embodiments the first lateral side 178 and the second lateral side 180 can be flat or smooth, in other embodiments surface enhancements are provided on at least one of the first lateral side 178 or the second lateral side 180. For example, FIG. 16 illustrates in cross-section of a portion of a glare reduction panel 146 having a plurality of prisms 147*a*-147*e* (generally 147) provided along the first and second lateral sides 178, 180 of the panel 146. In the illustrated embodiments, the prisms 147 are shown as rows that extend continuously from the first side edge 174 to the second side edge 176, but other geometries are contemplated. For example, the prisms 147 could be provided as discrete prisms or in discontinuous rows.

Each prism 147 includes an active surface 190 upon which light rays will impinge and a generally inactive surface 192 that connects active surface 190 of one prism 147 to the active surface 190 of an adjacent prism 147. Each active surface 190 is positioned at a prism slope angle θ relative to a central axis y that extends along the height h of the panel 146. The prism slope angle(s) θ of the active surfaces 190 controls the degree of refraction of the lights rays that impinge upon the active surface 190 of the prisms 147. Generally, the larger the prism slope angle θ, the larger extent to which a light ray is refracted downwardly. Conversely, the smaller the prism slope angle θ, the lesser extent to which a light ray is refracted downwardly. Therefore, the prism slope angles θ of each prism 147 may be tailored to control the refraction of any incoming light rays. In some embodiments, the prism slope angle θ of at least some or each prism is greater than 0° and less than 60°; less than 55°; less than 50°; less than 45°; less than 40°; less than 35°; less than 30°; less than 25°; and/or less than 20°. In some embodiments, the prism slope angle θ of at least some or each prism is between 5°-40°, inclusive; 10°-30°, inclusive; 10°-35°, inclusive; 10°-30°, inclusive; 15°-30°, inclusive; 15°-25°, inclusive; and/or 10°-20°, inclusive.

While all of active surfaces 190 may extend at the same prism slope angle θ, in other embodiments the prism slope angles θ of the active surfaces 190 vary along the height h of the glare reduction panel 146. For example, in FIG. 16, active surface 190 of prism 147*a* has a prism slope angle $\theta_a$ of approximately 20°, active surface 190 of prism 147*b* has a prism slope angle $\theta_b$ of approximately 18°, and active surface 190 of prism 147*c* has a prism slope angle $\theta_c$ of approximately 16°. Thus, in some embodiments the prism slope angles θ of adjacent prisms 147 decreases along the height h of a panel 146 from the proximal end 170 to the distal end 172. In some embodiments, the panels 146 are symmetrical about central axis y, but such is not a requirement.

Tapering of the glare reduction panels 146 along their height h and/or reducing the prism slope angles θ at which the prisms 147 are oriented from the proximal end 170 to the distal end 172 of the panels 146 helps to blend the light emitted from the panels 146 and prevent the creation of hot spots that result when the light rays leave the panels 146 at the same or similar exit angles such that they are concentrated on the same area.

In some embodiments (see, e.g., FIG. 18), prisms 147 are only provided on one of the first lateral side 178 or second lateral side 180 of a glare reduction panel 146. In such cases, the panel 146 will typically be oriented within the light fixture 100 such that the prisms 147 are on the light entrance side of the panel 146 facing the light sources 142. However, it may be beneficial to provide prisms 147 on both the first lateral side 178 and the second lateral side 180 of the panel 146 to facilitate redirection of high angle light as well as enhance the versatility of the panel 146 in that a single panel design may be used regardless of the position the panel will assume in the light fixture 100.

Figure 17:
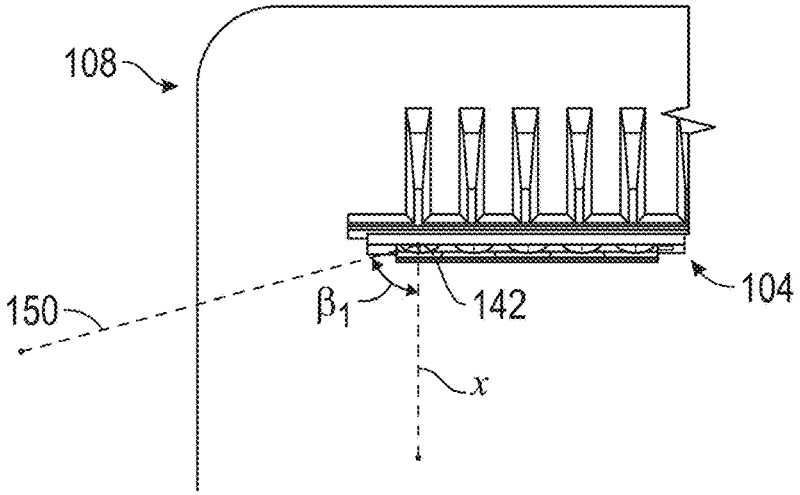
FIG. 17 depicts a ray trace of a single light ray emitted by the light engine of the light fixture of FIG. 1 that does not include a glare reduction panel.
Figure 18:
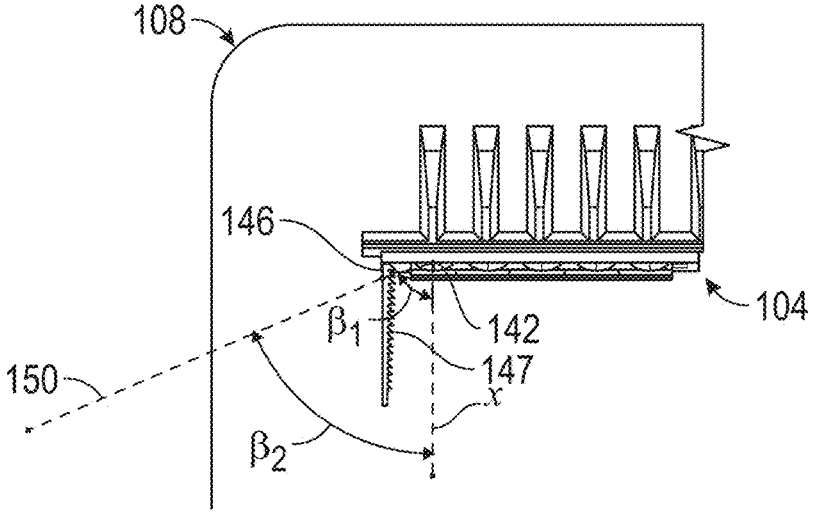
FIG. 18 depicts a ray trace of a single light ray emitted by the light engine of the light fixture of FIG. 1 that includes an embodiment of a glare reduction panel.
Figure 19:
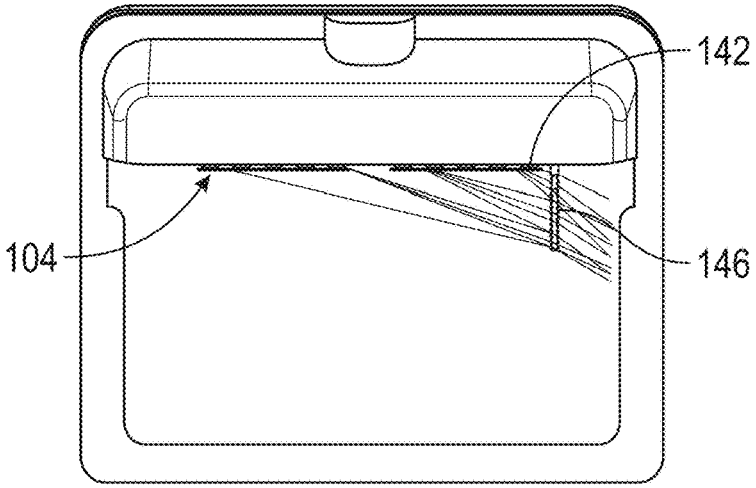
FIG. 19 depicts a ray trace of a plurality of light rays emitted by the light engine of the light fixture of FIG. 1 being redirected by an embodiment of a glare reduction panel.

A comparison of FIGS. 17 and 18 illustrates performance of a light fixture without and with glare reduction panels 146. FIG. 17 depicts a light ray 150 emitted from a light fixture 100 without glare reduction panels 146, and FIG. 18 depicts the same light ray 150 emitted from the light fixture 100 with glare reduction panels 146. Referring first to FIG. 17, light ray 150 is emitted from the light source 142 at an angle $\beta_1$ of approximately 75° and exits the light fixture at that approximate same angle. Referring now to FIG. 18, light ray 150 of FIG. 17 hits the glare reduction panel 146, which refracts the light ray 150 downwardly. Thus, while light ray 150 enters the glare reduction panel 146 at an entrance angle $\beta_1$ of approximately 75°, it exits the panel 146 an exit angle $\beta_2$ of approximately 67°. In this way, the entrance angles of light rays impinging on the panels 146 are greater than the exit angles of the light rays exiting the panels 146. FIG. 19 depicts a plurality of light rays emitted from the light sources 142 entering a glare reduction panel 146 at different entrance angles. The light rays exit the panel 146 at different exit angles, each of which is less than the entrance angle at which a light ray entered the panel 146.

Figure 20:
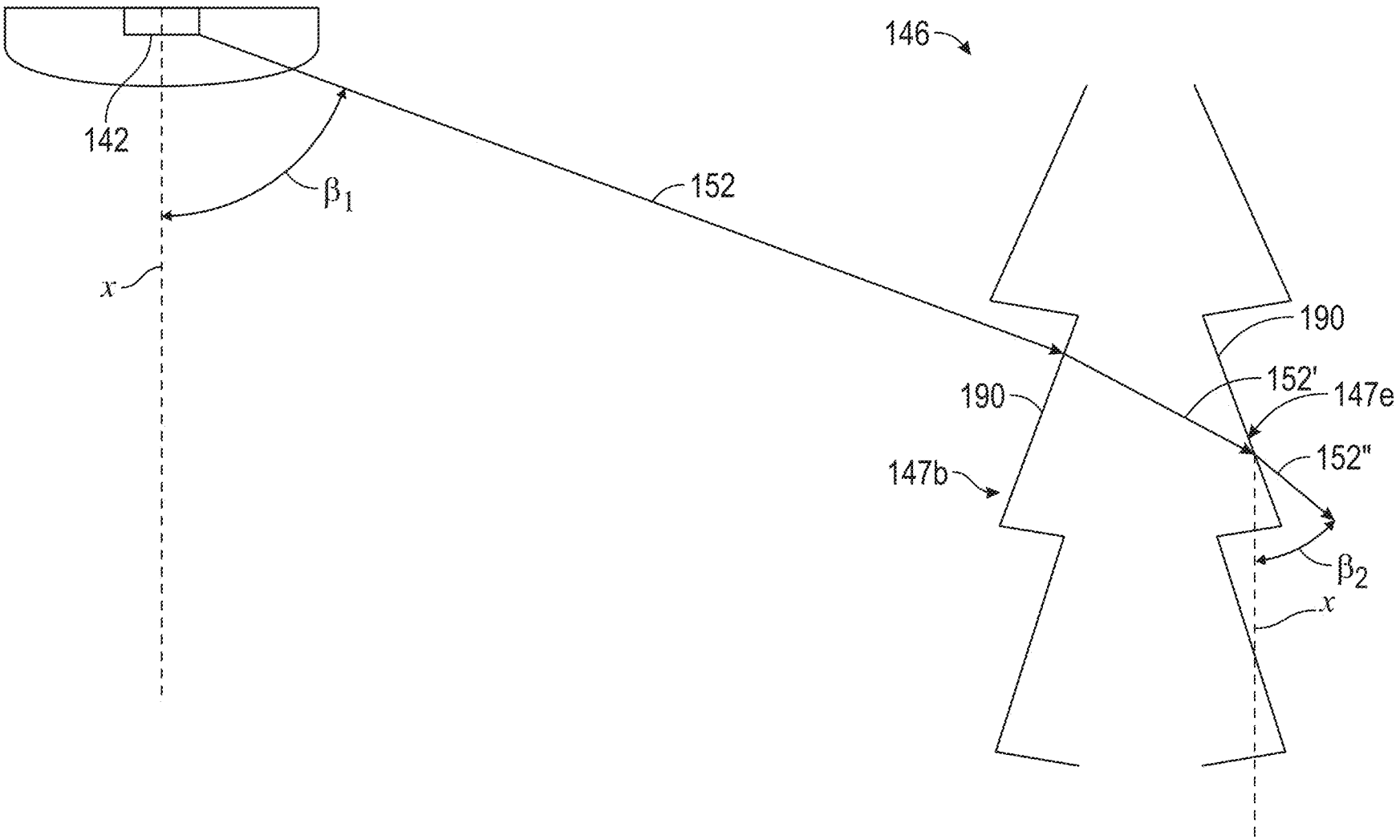
FIG. 20 depicts a ray trace of a single light ray traveling through an embodiment of a glare reduction panel.

Each light ray may be refracted twice by a glare reduction panel 146, as illustrated in FIG. 20 which illustrates a light ray 152 passing through a portion of an embodiment of a glare reduction panel 146. The glare reduction panel 146 of FIG. 20 is labeled similarly to that of FIG. 16. Light ray 152 is emitted from the light source 142 and enters the active surface 190 of prism 147*b* at an entrance angle $\beta_1$ of approximately 76°. The active surface 190 of the prism 147*b* refracts light ray 152 downwardly (as refracted light ray 152') toward the active surface 190 of prism 147*e*. Prism 147*e* further refracts refracted light ray 152', which exits the glare reduction panel 146 as refracted light ray 152" and at an exit angle $\beta_2$ of approximately 57.3°. This example simply depicts how a single light ray interacts with particular prisms 147 of a particular glare reduction panel 146. One of skill in the art will understand that the exit angles of light rays will depend on at least their entrance angles, the prism slope angles θ of the prisms 147 they impact, the thickness of the panel 146, and the material of the panel 146. In some embodiments, the glare reduction panels 146 are designed to refract high angle light rays emitted at and/or above 60°, 65°, 70°, and/or 75°(i.e., at entrance angles into the panel are above 60°, 65°, 70°, and/or 75°) such that the light rays exit the panel at exit angles at and/or below 60°, 65°, 70°, and/or 75°. In some embodiments, the exit angles of some of the light rays that pass through a glare reduction panel 146 are at least 5°; at least 8°; at least 10°; at least 12°; at least 15°; at least 18°; at least 20°; at least 22°; and/or at least 25° less than their entrance angle into the glare reduction panel 146.

Veiling luminance (VL) is a measure of disability glare and is measured and calculated pursuant to ANSI/IES RP-8-21*: Design of Roadway Facility Lighting* (2021 edition), incorporated herein by reference. A higher VL value indicates a higher degree of disability glare whereas a lower LV value indicates a lower degree of disability glare. The glare reduction panels 146 are configured to reduce glare, which in turn reduces the VL of a light fixture. In some embodiments, the panels 146 reduce the maximum VL of a light fixture by between 15% to 25%, or by at least 20%, compared to identical light fixtures devoid of glare reduction panels 146.

While the glare reduction panels 146 have been described as refractors, in other embodiments they could be reflectors that redirect high angle light. In such embodiments, the panels 146 may be formed of opaque or reflective materials that block and/or reflect the high angle light instead of bending it.

The light fixture 100 as described herein may be used in various situations and be placed on a variety of surfaces including, but not limited to: roads, highways, underpasses, tunnels, bridges retaining walls, commercial buildings, residential buildings, pedestrian walkways, and pathways. Additionally, the panels 146 be retrofitted into existing light fixtures 100, reducing the costs of manufacturing and replacing existing light fixtures with the light fixture 100 described above.

The various aspects, embodiments, implementations, or features of the described embodiments can be used separately or in any combination. In particular, it should be appreciated that the various elements of concepts from FIGS. 1-21 may be combined without departing from the spirit or scope of the invention.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall results as if absolute and total completion were obtained.

Preferred embodiments of this invention are described herein, including the best mode known to the inventors for carrying out the invention. The invention is susceptible to various modifications and alternative constructions, and certain shown exemplary embodiments there are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claim appended hereto as permitted by applicable law. Moreover, any combination of the above-described elements in all possible variations thereof is encompassed by the invention unless otherwise indicated herein or otherwise clearly contradicted by context. The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A light fixture having a front and opposing lateral sides and further comprising:

a housing;

at least one light source housed within the housing and comprising an optical axis, wherein the at least one light source is configured to emit a plurality of light rays towards the front and opposing lateral sides of the light fixture, wherein each light ray is emitted at a first angle relative to the optical axis; and at least one panel comprising a height and extending adjacent the at least one light source, wherein the at least one panel is positioned and configured only to receive and refract the light rays that are emitted by the at least one light source both (i) toward one of the opposing lateral sides of the light fixture and (ii) at first angles greater or equal to 65°, such that each of the light rays exits the at least one panel from one of the opposing lateral sides of the light fixture and at a second angle relative to the optical axis that is less than the first angle.

2. The light fixture of claim 1, wherein the at least one panel has a light entrance side facing the at least one light source and an opposing light exit side, wherein a plurality of prisms extends at least partially along the height of the at least one panel on the light entrance side of the at least one panel.

3. The light fixture of claim 2, wherein the plurality of prisms extends along both the light entrance side and the opposing light exit side of the at least one panel.

4. The light fixture of claim 3, wherein the at least one panel comprises a central axis that extends along the height, wherein the at least one panel is symmetrical about the central axis.

5. The light fixture of claim 2, wherein the at least one panel comprises a central axis and wherein at least some of the plurality of prisms each comprise a first prism surface that extends at a prism slope angle between 0° and 60°, inclusive, relative to the central axis.

6. The light fixture of claim 5, wherein the at least some of the plurality of prisms each further comprise a second prism surface that connects the first prism surfaces of adjacent prisms.

7. The light fixture of claim 5, wherein at least some of the prism slope angles of the first prism surfaces are different.

8. The light fixture of claim 7, wherein the at least some of the prism slope angles of the first prism surfaces decrease along the height of the at least one panel moving away from the at least one light source.

9. The light fixture of claim 1, wherein the at least one panel comprise a transparent material.

10. The light fixture of claim 9, wherein the transparent material comprises silicone.

11. The light fixture of claim 2, wherein the light rays emitted towards the opposing lateral sides of the light fixture are refracted at least once by the light entrance side and are refracted at least once by the opposing light exit side.

12. The light fixture of claim 1, wherein the housing includes a mounting platform that extends towards the front of the light fixture, wherein the at least one light source is mounted on the mounting platform.

13. The light fixture of claim 12, wherein the at least one panel is coupled to the mounting platform using at least one mounting bracket.

14. The light fixture of claim 1, wherein the at least one light source includes a plurality of light emitting diodes (LEDs) each having an optical axis.

15. The light fixture of claim 14, wherein the at least one panel extends between at least two of the plurality of LEDs.

16. The light fixture of claim 15, wherein the at least one panel extends approximately perpendicular relative to the optical axes of the at least two of the plurality of LEDs.

17. The light fixture of claim 1, further comprising a lens positioned to enclose an opening defined in the housing through which the light rays exit the light fixture, wherein the lens comprises a wall having a lens shape and wherein the at least one panel comprises a side edge proximate the lens and having an edge shape complimentary to the lens shape.

18. The light fixture of claim 1, wherein the at least one panel includes at least two panels positioned on opposing sides of the at least one light source.

19. The light fixture of claim 1, wherein the at least one panel further comprises a thickness that narrows along the height of the at least one panel moving away from the at least one light source.

20. A glare reduction panel comprising a first end, a second end opposite the first end, a first lateral side, a second lateral side opposite the first lateral side, a first side edge, a second side edge opposite the first side edge, a height defined between the first end and the second end, a length defined between the first side edge and the second side edge, a thickness defined between the first lateral side and the second lateral side, and a central axis along the height, wherein:

a. a plurality of prisms, at least some of which extend at least partially along the length and height of the panel on the first lateral side;

b. the plurality of prisms each comprise a first prism surface that extends at a prism slope angle between 0° and 60°, inclusive, relative to the central axis and a second prism surface that connects the first prism surface of a prism to the first prism surface of an adjacent prism; and c. at least some of the prism slope angles of the first prism surfaces are different, wherein the first lateral side is configured to be positioned within a light fixture adjacent a light source having an optical axis so as to receive only a subset of light rays that are emitted by the light source at first angles greater or equal to 65° relative to the optical axis and refract the subset of light rays such that each of the light rays of the subset of light rays exits the panel from the second lateral side at a second angle relative to the optical axis that is less than the first angle.

21. The glare reduction panel of claim 20, wherein other of the plurality of prisms extend at least partially along the length and height of the panel on the second lateral side.

22. The glare reduction panel of claim 20, wherein the panel is symmetrical about the central axis.

23. The glare reduction panel of claim 20, wherein the at least some of the prism slope angles of the first prism surfaces gradually decrease along the height of the panel from the first end to the second end.

24. The glare reduction panel of claim 20, wherein the thickness tapers along the height of the panel from the first end to the second end.

* * * * *